US010287934B2

(12) United States Patent
Harres et al.

(10) Patent No.: US 10,287,934 B2
(45) Date of Patent: May 14, 2019

(54) APPARATUS FOR MONITORING AN OIL THERMOSTAT

(71) Applicant: MAN Truck & Bus AG, München (DE)

(72) Inventors: Ulrich Harres, Nürnberg (DE); Rainer Kalaß, Rohr (DE); Christian Knauer, Taching am See (DE)

(73) Assignee: MAN Truck & Bus AG, Munich (DE)

( * ) Notice: Subject to any disclaimer, the term of this patent is extended or adjusted under 35 U.S.C. 154(b) by 0 days.

(21) Appl. No.: 15/524,838

(22) PCT Filed: Nov. 4, 2015

(86) PCT No.: PCT/EP2015/002214
§ 371 (c)(1),
(2) Date: May 5, 2017

(87) PCT Pub. No.: WO2016/070993
PCT Pub. Date: May 12, 2016

(65) Prior Publication Data

US 2017/0342877 A1 Nov. 30, 2017

(30) Foreign Application Priority Data

Nov. 6, 2014 (DE) ..... 10 2014 016 307

(51) Int. Cl.
*F01M 11/10* (2006.01)
*F01M 5/00* (2006.01)

(52) U.S. Cl.
CPC ..... *F01M 11/10* (2013.01); *F01M 5/007* (2013.01); *F01M 2011/1446* (2013.01); *F01M 2011/1473* (2013.01)

(58) Field of Classification Search
CPC . F01M 5/007; F01M 5/005; F01P 7/16; F01P 2060/04
See application file for complete search history.

(56) References Cited

U.S. PATENT DOCUMENTS 2,377,028 A * 5/1945 Nicholas ..... F01P 3/207 123/41.09
3,451,214 A * 6/1969 Bradley ..... B60B 33/04 184/6.22

(Continued)

FOREIGN PATENT DOCUMENTS

DE 4426494 A1 2/1996
DE 102014225117 A1 11/2015

OTHER PUBLICATIONS

International Search Report and Written Opinion issued in corresponding application No. PCT/EP2015/002214 dated Feb. 26, 2016.

(Continued)

*Primary Examiner* — Long T Tran
(74) *Attorney, Agent, or Firm* — Weber Rosselli & Cannon LLP

(57) ABSTRACT

The invention relates to an apparatus for monitoring an oil thermostat arranged in an oil circuit of an internal combustion engine. The apparatus comprises a sensor unit (4, 14*b;* 15) which is designed to determine at least one first parameter, by means of which a current setpoint operation of the oil thermostat (10) can be derived, and to determine at least one second parameter, by means of which a current actual operation of the oil thermostat (10) can be derived. The apparatus further comprises an evaluation device (40), which is designed to detect an onset of an error function of the oil thermostat (10) as a function of the first parameter and the second parameter.

15 Claims, 7 Drawing Sheets

(56) References Cited

U.S. PATENT DOCUMENTS

| | | | | |
|---|---|---|---|---|
| 5,568,842 | A * | 10/1996 | Otani | F01M 1/02 123/196 AB |
| 7,124,715 | B2 * | 10/2006 | Hutchins | B60H 1/00314 123/41.1 |
| 7,219,643 | B2 * | 5/2007 | Hoi | B63H 21/21 123/196 AB |
| 9,353,750 | B2 * | 5/2016 | Halttunen | F04B 39/0207 |
| 2004/0173012 | A1 | 9/2004 | Tsukamoto et al. | |
| 2004/0216700 | A1 * | 11/2004 | Hutchins | B60H 1/00314 123/41.08 |
| 2005/0006487 | A1 * | 1/2005 | Suda | F01P 7/167 236/46 R |
| 2008/0083586 | A1 * | 4/2008 | Kobayashi | F01M 5/02 184/6.4 |
| 2010/0032490 | A1 * | 2/2010 | Mabboux | G05D 23/023 236/93 R |
| 2012/0207621 | A1 * | 8/2012 | Halttunen | F04B 39/0207 417/53 |
| 2015/0330273 | A1 | 11/2015 | Chung et al. | |

OTHER PUBLICATIONS

Chinese Office Action issued in corresponding CN Application No. 201580060309.2 dated Dec. 7, 2018 (English translation not available).

* cited by examiner

APPARATUS FOR MONITORING AN OIL THERMOSTAT

The invention relates to an apparatus for monitoring an oil thermostat arranged in an oil circuit of an internal combustion engine.

It is known from the prior art to monitor the function of a cooling system of an internal combustion engine, which has to ensure that the engine temperature does not become too high. Thus, for example, DE 44 26 494 A1 discloses a device for monitoring the cooling system in an internal combustion engine, in which a temperature signal characteristic of the cooling system is produced and subsequently the progression of the temperature signal is evaluated, and temperature changes identified per unit of time are compared with plausible values.

It is furthermore known in practice that not only cooling water thermostats are used in the cooling water circuit, but increasingly also oil thermostats are used in the oil circuit of an internal combustion engine. The frictional power in specific operating states can be reduced by means of oil thermostats of this type in order thereby to afford fuel consumption advantages in relation to conventional engines. For this purpose, the oil thermostat supplies the oil supplied to it either to a flow branch with an oil cooler or to a bypass flow branch circumventing the oil cooler depending on the oil temperature. A defective thermostat which can no longer conduct the oil via the oil cooler has generally resulted in engine power damage because of the excessively high oil temperature. A defective oil thermostat which is configured in its failure behavior, in the event of a loss of function to take up the switching state in which the oil is always conducted via the oil cooler, in order thus to prevent rapid damage to the internal combustion engine, leads, on the other hand, because of the increased frictional power, to an increased fuel consumption and CO2 emission over the longer term. Furthermore, there is the possibility of failure of the oil thermostat taking place with an undefined state, for example due to dirt (original dirt, sand . . . ), particles or chips, or due to mechanical forces or high pressure peaks which may lead to thermostat deformations which, as a result, may lead to jamming in any arbitrary thermostat position. It should be mentioned in this connection that, in the oil circuit in the case of current engines, hydraulic pressure peaks of up to 60 bar may occur, in particular since, in the event of a cold start, oil may be highly viscous.

A defective water thermostat in the cooling water circuit can generally already be identified by the fact that the operating temperature of the internal combustion engine is no longer reached or is reached only very sluggishly. By contrast, a defect of the oil thermostat cannot be identified by a driver, or at least not promptly, since a defective oil thermostat which always supplies the oil to the oil cooler generally does not impair the cooling function of the cooling system, but instead the fuel consumption, the wear and the service life of the internal combustion engine over the longer term. Even by means of the device mentioned in DE 44 26 494 A1 mentioned above, only a general malfunction of the cooling system can be identified, but not whether specifically the oil thermostat has a malfunction. Furthermore, the checking and the exchange of the oil thermostat in a service is comparatively complicated since, for access to the oil thermostat, the coolant circuit has to be opened and other components, such as, for example, the oil filter head, may have to be removed. A malfunction of the cooling system due to a defective oil thermostat should therefore be identified as reliably as possible and should be attributable to the oil thermostat in order to avoid unnecessary workshop work.

It is therefore an object of the invention to provide an apparatus for monitoring an oil thermostat arranged in an oil circuit of an internal combustion engine, with which disadvantages of conventional techniques can be avoided. It is the object of the invention in particular to reliably identify a defect or a malfunction of the oil thermostat.

This object is achieved by an apparatus with the features of the main claim. Advantageous embodiments and uses of the invention are the subject matter of the dependent claims and are explained in more detail in the description below with reference at times to the figures.

According to the invention, an apparatus for monitoring an oil thermostat valve arranged in an oil circuit of an internal combustion engine is proposed.

The oil thermostat valve (referred to for short below as oil thermostat) monitored by the apparatus is designed in a manner known per se to supply an oil flow to a bypass flow branch and/or to a flow branch having an oil cooler, depending on a temperature of the oil flow supplied to the oil thermostat. In this case, the oil thermostat supplies the oil typically exclusively to the bypass flow branch when the oil temperature at the oil thermostat, also referred to below as the admission temperature, lies below a first temperature threshold value. Within this temperature range, a first outlet of the oil thermostat, which outlet is assigned to the first flow branch, is closed and is opened only when the first temperature threshold value is exceeded. The oil thermostat can furthermore be designed to close the bypass flow branch above a second temperature threshold value which preferably lies above the first temperature threshold value. The two flow branches are opened within the temperature range between the two temperature threshold values, wherein a second outlet of the oil thermostat, which outlet is assigned to the bypass flow branch, gradually closes until the second temperature threshold value is reached. Depending on the design of the oil thermostat, the first and second temperature threshold value may also be identical.

According to general aspects of the invention, the apparatus for monitoring the oil thermostat comprises a sensor device which is designed to determine at least one first parameter by means of which a current desired operation of the oil thermostat can be derived, and to determine at least one second parameter by means of which a current actual operation of the oil thermostat can be derived. The apparatus furthermore comprises an evaluation device which is designed, depending on the first parameter and the second parameter, to identify an occurrence of a malfunction of the oil thermostat.

A desired operation of the oil thermostat is understood as meaning a normal operation, i.e. without a presumed malfunction, in which the oil thermostat assumes the desired temperature-dependent operating state, for example the desired temperature-dependent desired position or movement of the final control element of the oil thermostat. The actual operation is understood as meaning an actual operation of the oil thermostat, for example an actual current operating state. If a malfunction does not occur, desired operation and actual operation correspond. In the event of a malfunction, the actual position of the oil thermostat and/or the actual movement of the final control element of the oil thermostat may differ from the desired operation.

The oil thermostat can be a sleeve valve oil thermostat or an expansion element oil thermostat, in particular a wax expansion oil thermostat. The oil thermostat can furthermore be designed as a mechatronic actuator, with an electronic control unit which activates a mechanical final control element depending on the oil temperature.

According to a preferred embodiment, the sensor device is designed to measure the admission temperature of the oil and in particular the progression of said admission temperature over time, for example by means of a temperature sensor in the admission line to the oil thermostat, as the first parameter. The admission temperature is a measure of the oil temperature which prevails at the inlet of the oil thermostat and, depending on which, the oil thermostat assumes a predefined opening or closing position with respect to the outlets to the first and second flow branch in the desired operation. It is particularly advantageous to measure the oil sump temperature as the admission temperature since a temperature sensor which can be used is generally already present in the oil sump of the oil circuit. The oil sump temperature can be measured, for example, by means of an oil sump temperature sensor which is integrated in the already existing oil level sensor of the oil sump. The oil sump temperature substantially corresponds to the oil temperature prevailing at the inlet of the oil thermostat. Since the oil temperature of the oil conveyed from the oil sump to the oil thermostat via an admission line does not change substantially, the admission temperature can also be established at any other point along the admission line by means of a correspondingly arranged temperature sensor.

In an advantageous variant of the embodiment in which the sensor device measures the admission temperature as the first parameter, the sensor device can furthermore be designed to measure a second oil temperature downstream of the oil cooler and upstream of the internal combustion engine, and to determine a temperature difference ΔT from the admission temperature minus the second oil temperature as the second parameter.

For the measuring of the second oil temperature, a temperature sensor can be provided which is arranged in the first flow branch downstream of the oil cooler and upstream of a junction of the first flow branch and of the bypass flow branch. However, the temperature sensor can also be arranged downstream of an oil filter arranged from the internal combustion engine. The temperature sensor is preferably designed as a combined pressure and temperature sensor which are installed in a structural unit. A further advantageous possibility is to integrate the temperature sensor in an oil filter head.

According to these variants, the evaluation device can be designed to identify the occurrence of a malfunction of the oil thermostat with reference to at least one of the three following conditions (a) to (c):

(a) A malfunction of the oil thermostat is identified when the admission temperature lies below the first temperature threshold value, at least one predetermined reaction period has elapsed since the admission temperature has been below the first temperature threshold value, and the temperature difference ΔT from the admission temperature minus the second oil temperature is greater than a first threshold value.

In other words, in this case, the first outlet of the oil thermostat to the cooler would actually have to be closed according to the desired operation because of the low admission temperature. If, however, the temperature difference ΔT is greater than a first threshold value, it can be concluded therefrom that oil cooling is taking place and the oil therefore has to run through the flow branch with the cooler, and therefore there is a malfunction of the thermostat.

This first threshold value is defined depending on the reduction of the oil temperature (cooling power of the oil cooler), which reduction is produced by the oil cooler. The first threshold value should be, for example, greater than customary oil temperature fluctuations, not caused by the oil cooler, in the region between the oil sump and internal combustion engine, but somewhat smaller than the average cooling power of the oil cooler. The predetermined reaction period takes into account a time-delaying behavior of the oil thermostat and constitutes a period up to which, after a change of the switching position of the oil thermostat, the temperature difference ΔT thereby resulting downstream of the oil thermostat would have to be adjusted. The reaction period depends on the type of oil thermostat and on the position of the measurement point for the second temperature and can be defined, for example, experimentally.

(b) The occurrence of a malfunction of the oil thermostat can furthermore be identified whenever the admission temperature lies above the first temperature threshold value, at least the predetermined reaction period has elapsed since the admission temperature has been above the first temperature threshold value, and the temperature difference ΔT is smaller than a second threshold value. In other words, when an admission temperature is above the first temperature threshold value, the oil flow supplied to the oil thermostat would then have to be conducted to the oil cooler. If this is not the case, this can be ascertained in turn with reference to the temperature difference which is smaller than during cooling of the oil by the oil cooler. The second threshold value can be fixed, for example, somewhat below the differential temperature ΔT normally brought about by the cooler.

(c) The occurrence of a malfunction of the oil thermostat can furthermore be identified whenever, after the first temperature threshold value is exceeded by the admission temperature, a gradient, in particular an increase of the temperature difference ΔT, proceeds more slowly than a predefined desired increase of the temperature difference. The evaluation device therefore evaluates the progression of the differential temperature over time and can compare said progression with a stored desired increase of the temperature difference. A particular advantage of this variant resides in the fact that the evaluation of the increase of the temperature difference can be used as an early indicator for the onset of a malfunction of the oil thermostat. Investigations within the context of the invention have shown that, prior to a complete malfunction of the oil thermostat, the final control element thereof shows the onset of jamming or sticking such that it does not open gradually, but rather moves relatively late. This can be identified on the basis of a delayed increase of the differential temperature.

To further improve the accuracy of identifying a malfunction, the aforementioned threshold values can be selected depending on the engine speed in such a manner that, in the event of a greater current engine speed, larger threshold values are set. This takes into account the fact that, as the engine speed increases, the cooling power of the oil cooler increases and therefore so does the anticipated value of the temperature difference.

Within the context of the invention, there is furthermore the possibility for the sensor device to be designed to measure, as the second parameter, an oil pressure progression, in particular a progression of the oil pressure over time, by means of a pressure sensor at a pressure measurement point which is arranged downstream of the first outlet of the oil thermostat and upstream with respect to the internal combustion engine. According to this variant, the evaluation device is designed to identify a malfunction of the oil thermostat when the measured progression of the oil pressure over time does not show any pressure swing in the form of a negative or positive peak within a range of the admission temperature that lies between the first oil temperature threshold value and the aforementioned second temperature threshold value. Such a pressure swing corresponds to a peak-shaped change in pressure, the peak height of which is greater than a predetermined value. This is based on the finding that the flow resistance within the temperature range, in which the first flow branch with the oil cooler is already open and the bypass flow branch is not yet completely closed, is minimal and therefore the pressure progression within this temperature range would have to have a peak when the oil thermostat functions without error. If said pressure peak is lacking, a malfunction of the oil thermostat could be deduced therefrom. This predetermined value for identifying a pressure swing can be defined experimentally in a manner specific to the oil circuit in such a manner that pressure swings which exceed this value do not result from normal pressure fluctuations but rather from a changed flow resistance downstream of the oil thermostat corresponding to an at least partially open first and second flow branch.

A particularly advantageous variant of this embodiment makes provision here for the pressure measurement point or the pressure sensor for measuring the progression of the oil pressure over time to be arranged in the first flow branch between the first outlet of the oil thermostat and the oil cooler and for the pressure swing to be a negative peak.

However, there is also the possibility of arranging the pressure measurement point downstream of the oil cooler and after a junction of the first flow branch and of the bypass flow branch. In this case, the anticipated pressure swing during the desired operation is a positive peak and the peak height.

It has already been mentioned above that the admission temperature of the oil can be measured as the first parameter, wherein preferably the oil sump temperature is measured as the admission temperature. The desired operating state of the oil thermostat can be directly deduced from the current admission temperature since the final control element of the oil thermostat takes up the predetermined control positions depending on the admission temperature.

Within the context of the invention, there is, however, also the possibility of using other characteristic variables for the first parameter from or with which the desired operation of the oil thermostat can likewise be deduced in order thereby to use variables which are already present or provided in the vehicle. For example, the cooling water temperature can be used since the progressions of the oil temperature and of the cooling water temperature during the desired operation are correlated with each other. From the cooling water temperature, it is therefore possible to deduce a progression of the oil temperature in the admission line, from which, in turn, the desired operation of the oil thermostat can be deduced.

Furthermore, defined operating states of the vehicle can be used. One example of this is the operating state when the vehicle carries out a cold start, or during a journey at full load. In the event of a cold start, the oil admission temperature is below the first temperature threshold value, and therefore the first flow branch to the oil cooler would have to be closed during normal operation. Conversely during a journey at full load, this flow branch is generally open if no defect is present.

In combination with the abovementioned various possibilities of determining at least one first parameter by means of which a current desired operation of the oil thermostat can be deduced, the following further variant embodiments for determining at least one second parameter by means of which a current actual operation of the oil thermostat can be deduced exist within the context of the invention.

A further possibility of the realization according to the invention makes provision, for example, to determine a gradient of an admission temperature of the oil as the second parameter. For this purpose, a gradient of the oil sump temperature is preferably determined. According to this variant, the evaluation device is designed to establish, depending on the determined value of the first parameter, a predetermined desired characteristic curve of the gradient of the admission temperature, which desired characteristic curve is stored in the memory of the evaluation device, and to identify a malfunction of the oil thermostat when the measured gradient of the admission temperature does not correspond within a predetermined limit to the desired characteristic curve.

An example in which an operating state of the vehicle is determined as the first parameter is explained below. If the vehicle, for example at full load, travels up a slope, a known temperature increase which has been determined beforehand experimentally and stored in the form of a characteristic curve in the evaluation device results therefrom in the oil sump. If the evaluation device on the basis of the determined operating state identifies travel at full load, the evaluation device compares the measured temperature increase of the admission temperature with the previously stored characteristic curve for travel at full load. If the current temperature increase of the oil admission temperature, which temperature increase is determined with reference to the second parameter, deviates from the previously stored temperature increase according to the characteristic curve, a malfunction of the oil thermostat can in turn be deduced therefrom.

Within the context of the invention there is furthermore the possibility that the sensor device is designed to detect a position and/or a movement of a final control element of the oil thermostat as the second parameter. In this case, the evaluation device is designed to identify the malfunction of the oil thermostat on the basis of the detected position and/or movement of the final control element by the detected position and/or movement of the final control element being compared with the anticipated position and/or movement according to the desired operation determined depending on the first parameter. For example, the malfunction of the oil thermostat can be disclosed when no movement of the final control element is detected within a predefined oil temperature range or cooling water temperature range in which the final control element would have to move. Furthermore, the malfunction of the oil thermostat can be identified when, during a cold start, the final control element is in a position in which the first outlet is open, and/or when, during the driving mode at full load, the final control element is in a position in which the first outlet is closed.

To identify a position and/or movement of the final control element, a displacement sensor can be provided which is mechanically coupled in terms of movement to the final control element. For example, the displacement sensor can have a coupling rod which is coupled in terms of movement to the final control element of the oil thermostat.

An alternative variant here makes provision for the sensor device to be designed as an electric oscillating circuit with a coil, wherein the coil is arranged from the outside on or in the vicinity of the oil thermostat in such a manner that a movement of the final control element of the oil thermostat changes the inductance of the coil and therefore an oscillation frequency of the oscillating circuit.

According to a further variant, the sensor device can have a transmitter coil and a receiver coil which are each arranged on opposite sides from the outside on or in the vicinity of the oil thermostat, and therefore a movement of the final control element of the oil thermostat changes a signal induced into the receiver coil by the transmitter coil.

The advantage of the two latter variants over a mechanical coupling to the final control element is that there is no contact with the thermostatically regulated medium (oil) and no additional sealing elements, as would be necessary in the case of a coupling rod, are required. A further advantage is that the monitoring system element in the form of the sensor device with the at least one coil has a substantially greater average service life than the element (oil thermostat) being monitored and therefore the oil thermostat can be monitored throughout the entire service life of the vehicle.

An advantageous variant of the aforementioned sensor devices with an oscillating circuit or transmitter and receiver coil makes provision for the apparatus to be designed as a mobile test apparatus for workshop use. The mobile test apparatus furthermore comprises fastening means in order to arrange the sensor apparatus on the outside on or in the vicinity of the oil thermostat temporarily for a measurement operation. Even oil thermostats of vehicles which are not equipped ex works with a monitoring apparatus for the oil thermostat can therefore be checked retrospectively with little outlay on maintenance.

Within the context of the invention, there is furthermore the possibility of designing the sensor device as a switching circuit which is integrated in the oil thermostat and is designed to detect a position and/or movement of the final control element of the oil thermostat by means of integrated switching contacts. For example, the switching circuit can be designed in such a manner that it monitors the end positions of the valve disk of the oil thermostat by means of corresponding switching contacts. The integrated switching circuit is furthermore designed in such a manner that it extracts its supply energy from the oil heat by means of an energy-harvesting switching circuit and transmits a measurement signal wirelessly, preferably by means of a close range radio transmission, to the evaluation device. An advantage of this variant is, in turn, that no additional sealing elements have to be provided for the mounting of the sensor apparatus since the integrated switching circuit is provided in the interior of the oil thermostat without having a mechanical connection to the outside.

A further possibility for configuring the sensor device makes provision to arrange a temperature sensor at a measurement point which is arranged in the first flow branch between the oil thermostat and the oil cooler. The oil temperature measured therewith downstream of the first outlet of the oil thermostat and also before the oil cooler can firstly be determined as the first parameter of the sensor device since the temperature approximately corresponds to the admission temperature. The desired operation of the oil thermostat can therefore be deduced from the measured temperature.

If the first parameter is determined, however, on the basis of one of the other previously mentioned alternatives, the temperature measurement directly after the first outlet of the oil thermostat can also be used for determining the second parameter. A malfunction of the oil thermostat can be detected by the evaluation device, for example whenever the measured oil temperature at this point remains substantially unchanged since an opening or closing of the first outlet would have to have taken place according to the determined first variable.

With the present invention, two or more thermostats in a parallel connection can also be monitored, for example a small thermostat and a large thermostat which have either identical or else different temperature settings and in which the outflow of the oil supplies different pressure oil consumers.

A further aspect of the invention relates to a vehicle, in particular a commercial vehicle, with an apparatus as disclosed herein. The previously described preferred embodiments, variants and features of the invention can be combined with one another as desired. Further details and advantages of the invention are described below with reference to the attached drawings, in which:

FIG. 1 shows schematically the parts of an oil circuit 1, wherein only that part of the oil circuit which is arranged in the flow progression between oil sump and internal combustion engine is illustrated.

Figure 1:
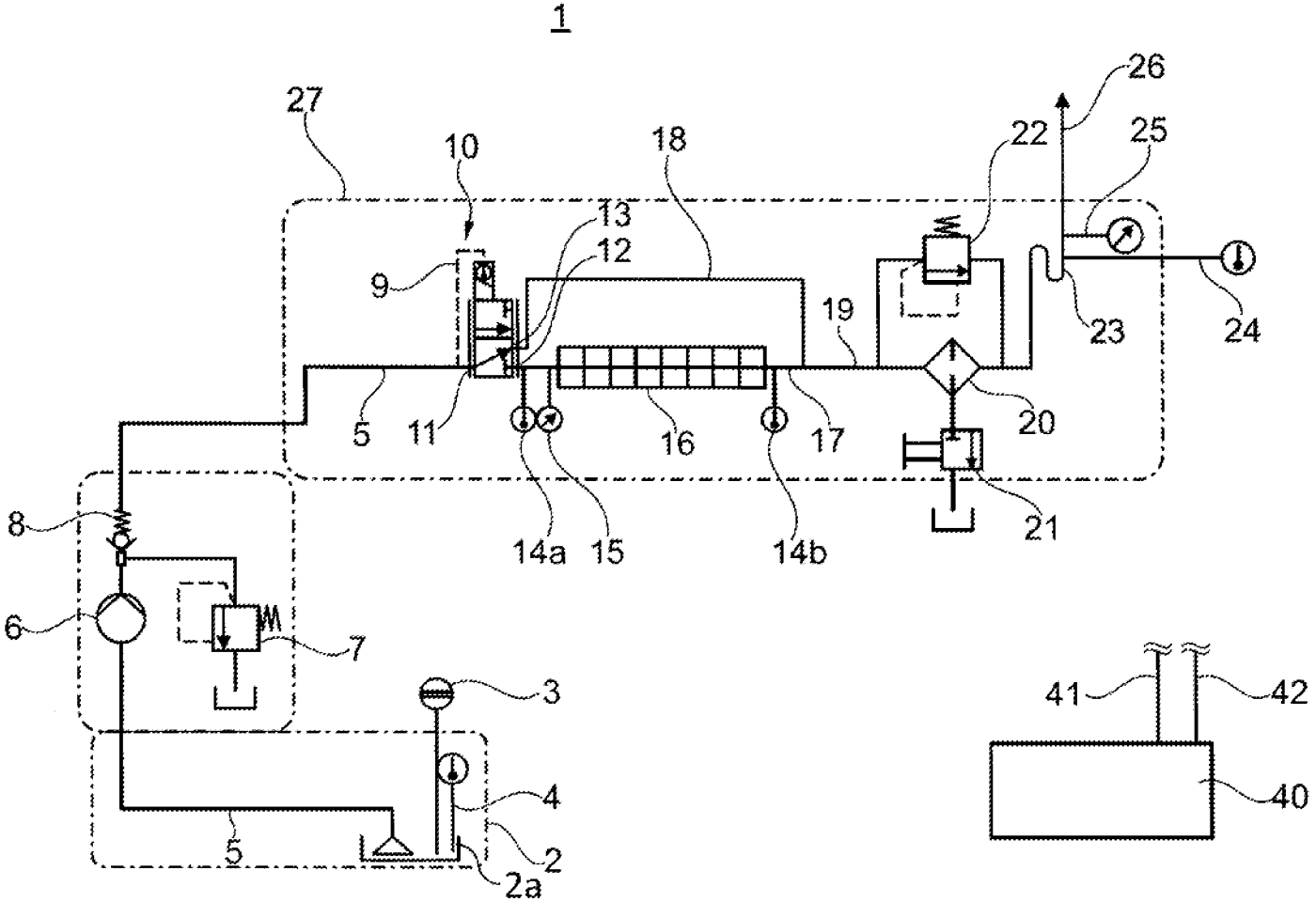
FIG. 1 shows a schematic illustration of an oil circuit of an internal combustion engine for illustrating various embodiments.

Arranged in the oil circuit 1 is an oil pan 2 in which the oil sump 2*a* is arranged, the filling level of which is monitored with an oil level probe 3. The oil from the oil sump 2*a* is supplied to the throughflow inlet 11 of an oil thermostat 10 via an admission line 5. An oil pump 6, a pressure control valve 7 and a non-return valve 8 are arranged in the admission line 5.

The oil thermostat 10 is designed, for example, as a sleeve valve oil thermostat or wax expansion oil thermostat and contains a final control element which moves into a determined position depending on the oil temperature (admission temperature T2) prevailing at the inlet 11 of the oil thermostat 10. Via the line 9, the oil supplied to the oil thermostat lies against a control inlet of the oil thermostat valve 10 and, for example, in the case of a wax expansion thermostat, leads, depending on the oil temperature, to heating and therefore expansion or to cooling and contraction of the final control element of the oil thermostat, and therefore the valve disks of the final control element are moved in order to open or to close a first outlet 12 of the oil thermostat 10 and to close or to open the second outlet 13 of the oil thermostat 10.

If the admission temperature T2 of the oil is lower than a first temperature threshold value T1, that outlet 12 of the oil thermostat 10 which connects the admission line 5 to a first flow branch 17 in which an oil cooler 16 is arranged is closed. The oil is instead supplied via the second outlet 13 of the oil thermostat 10 to a second bypass flow branch 18 which circumvents the oil cooler 16. If, by contrast, the admission temperature T2 is greater than a second temperature threshold value T1* which lies above the value T1, the second outlet 13 is completely closed and the first outlet 12 opened, and therefore the oil flows exclusively via the oil cooler 16. In the region between T1 and T1*, the first outlet is opened and the second outlet is only partially closed.

The first flow branch 17 and the second flow branch 18 are brought together after the oil cooler 16 to form a common flow portion 19. The oil then flows through an oil filter 20 which furthermore has a filter service valve 21 and a filter-circumventing valve 22. The oil filter 20 is followed downstream by a syphon 23 in the oil filter head and an oil pressure sensor 25 integrated in the oil filter head. The oil is subsequently supplied to the internal combustion engine (not illustrated) via the line portion 26.

The above-described components of the oil circuit 1 are known per se from the prior art and do not have to be described in further detail here.

According to the invention, an apparatus for monitoring the oil thermostat is furthermore provided in order to be able to identify a malfunction of the oil thermostat. The apparatus comprises a sensor device which is designed to determine at least one first parameter by means of which or from which a current operation of the oil thermostat 10 can be deduced.

For this purpose, the sensor device can comprise, for example, a temperature sensor 4 which determines the oil sump temperature as the first parameter. The oil sump temperature T2 substantially corresponds to the oil temperature which prevails at the oil thermostat 10 and which, in the desired operation, determines the position of the final control element. The oil sump temperature sensor 4 can be integrated in the oil level sensor 3 and can be provided as what is referred to as a combination sensor. As already mentioned above, the desired operation state of the oil thermostat 10 can be deduced directly from the determined oil sump temperature. As already explained above, the first outlet 12 to the first flow branch 17 having the oil cooler 16 is closed at oil sump temperatures of $T2<T1$. At a temperature of $T2 \geq T1$ and $T2 \leq T1^*$, the throughflow through the first flow branch 17 is open, and the bypass flow branch 18 is likewise also partially open. Within a range of the oil sump temperature of $T2>T1^*$ the throughflow through the first flow branch 17 is completely opened and the second outlet 13 and therefore the bypass flow branch 18 are completely closed. Exemplary values for T1 lie within the range of 95 degrees to 105 degrees and approx. 120 degrees for T1*.

The sensor device of the apparatus for monitoring the oil thermostat is furthermore designed to determine a second parameter by means of which a current actual operation of the oil thermostat can be deduced. For this purpose, for example use can be made of the temperature sensor 14*b* which is arranged downstream of the oil cooler 16 in the first flow branch 17 before the latter is brought together with the bypass flow branch 18. A second oil temperature T3 downstream of the oil cooler 16 can be measured with this temperature sensor 14*b*. From said second oil temperature T3, a temperature difference ΔT can then be determined from the admission temperature T2 minus the second oil temperature T3, on the basis of which temperature difference it can then be ascertained whether the actual operation of the oil thermostat 10 corresponds to the anticipated desired operation.

Figure 2:
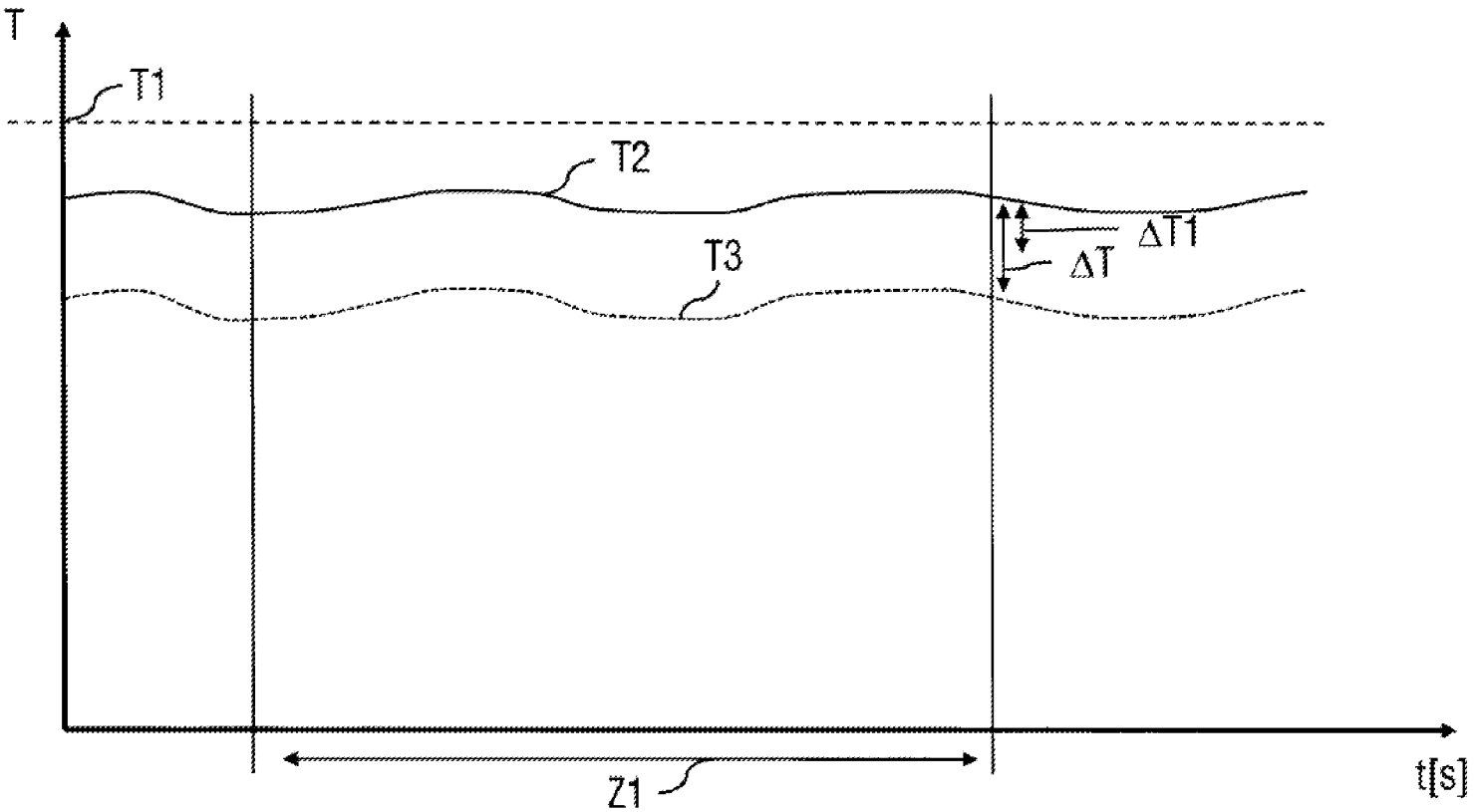
FIG. 2 shows a characteristic temperature progression in the event of a malfunction of the oil thermostat.

This is illustrated, for example, in FIG. 2. FIG. 2 shows a progression of the admission temperature T2, which has been determined by means of the sensor 4, over time, and a progression of the second oil temperature T3, which has been measured with the sensor 14*b* downstream of the oil cooler 16, over time. The dashed line T1 indicates the threshold value of the opening temperature T1.

In the illustrated case, the admission temperature T2 is lower than the opening temperature T1 of the first outlet 12 of the oil thermostat 10. During the desired operation, oil would therefore not be permitted to flow through the first flow branch since the first outlet 12 would have to be closed in this case. However, FIG. 2 shows a temperature progression which occurs in the event of a malfunction of the oil thermostat 10, for example in the event of a defect of the final control element, wherein oil flows through the oil cooler 16 even at admission temperatures of $T2<T1$. As a result, the oil is cooled down by the oil cooler 16 by the amount ΔT.

An evaluation unit 40 connected to the sensor device 4, 14*b* via a signal input line 41 then checks on the basis of the established measurement values whether the determined temperature difference ΔT has a value which is anticipated according to a desired operation, or whether there is a malfunction of the oil thermostat 10. The evaluation unit 40 checks whether the temperature difference ΔT from the admission temperature T2 minus the second oil temperature T3 is smaller than a predetermined first temperature threshold value ΔT1.

A malfunction of the oil thermostat is identified when the admission temperature lies below the first temperature threshold value, at least one predetermined reaction period Z1 has elapsed since the admission temperature has been below the first temperature threshold value T1, and the temperature difference ΔT from the admission temperature minus the second oil temperature is greater than a first threshold value ΔT1.

If, however, the temperature difference ΔT is greater than a first threshold value ΔT1 it can be concluded therefrom that oil cooling takes place and therefore the oil has to be run through the flow branch 17 with the cooler 16, and therefore there is a malfunction of the thermostat 10.

The first threshold value ΔT1 is defined depending on the reduction of the oil temperature (cooling power of the oil cooler) which reduction is produced by the oil cooler. The first threshold value should be, for example, greater than customary oil temperature fluctuations, which are not caused by the oil cooler, in the region between oil sump and internal combustion engine, but somewhat smaller than the average cooling power of the oil cooler. The predefined reaction period Z1 takes into account a time-delaying behavior of the oil thermostat and constitutes a period up to which, after a change of the switching behavior of the oil thermostat, the temperature difference ΔT resulting therefrom downstream of the oil thermostat would have to be adjusted. The reaction period depends on the type of oil thermostat and on the position of the measurement point for the second temperature and can be defined, for example, experimentally.

If the evaluation device 40 identifies a malfunction of the oil thermostat 10, it outputs a warning signal via the output line 42, said warning signal being output, for example, via a display apparatus in the cockpit of the vehicle.

Figure 3:
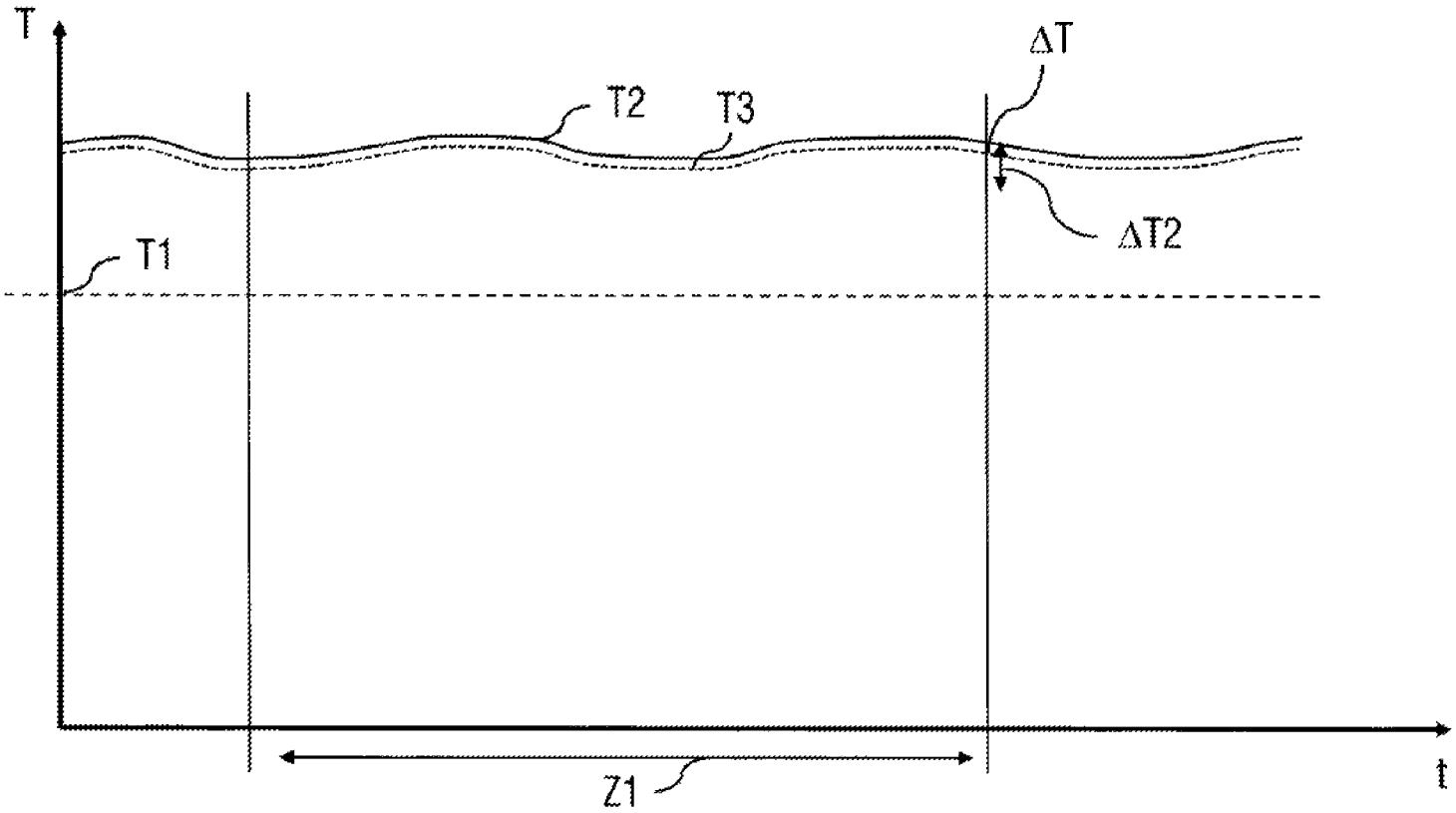
FIG. 3 shows a characteristic temperature progression in the event of a malfunction of the oil thermostat.

FIG. 3 shows the temperature progression in the event of a malfunction of the oil thermostat 10, in the event of which the oil thermostat 10 despite an admission temperature T1 which is greater than the first temperature threshold value T1 does not pass into a position in which the first outlet 12 is opened and oil flows through the oil cooler 16. This can be seen in FIG. 3 by the fact that the temperature difference ΔT from admission temperature minus the second temperature T3, which is measured by means of the temperature sensor 14*b* is smaller than a predetermined second temperature threshold value ΔT2. Depending on the cooling power of the oil cooler 16, the threshold value ΔT2, is selected in such a manner that a temperature difference ΔT is always greater than the threshold value ΔT2 when the oil flows through the oil cooler 16. The small distance of the temperature T3 from the admission temperature T2 indicates on the contrary that a defective oil thermostat has to be present. The fact that the temperature progression T3 lies somewhat below the temperature profile T2 results from the fact that the bypass flow branch 18 is arranged spatially in the vicinity of the oil cooler 16 and thereby radiates cooling power somewhat from the oil cooler 16 and also slightly cools the oil in the bypass flow branch 18. In order to avoid erroneous measurements, the evaluation of the differential temperature ΔT is in turn carried out only after a predetermined reaction period of time Z1 has elapsed.

Figure 4:
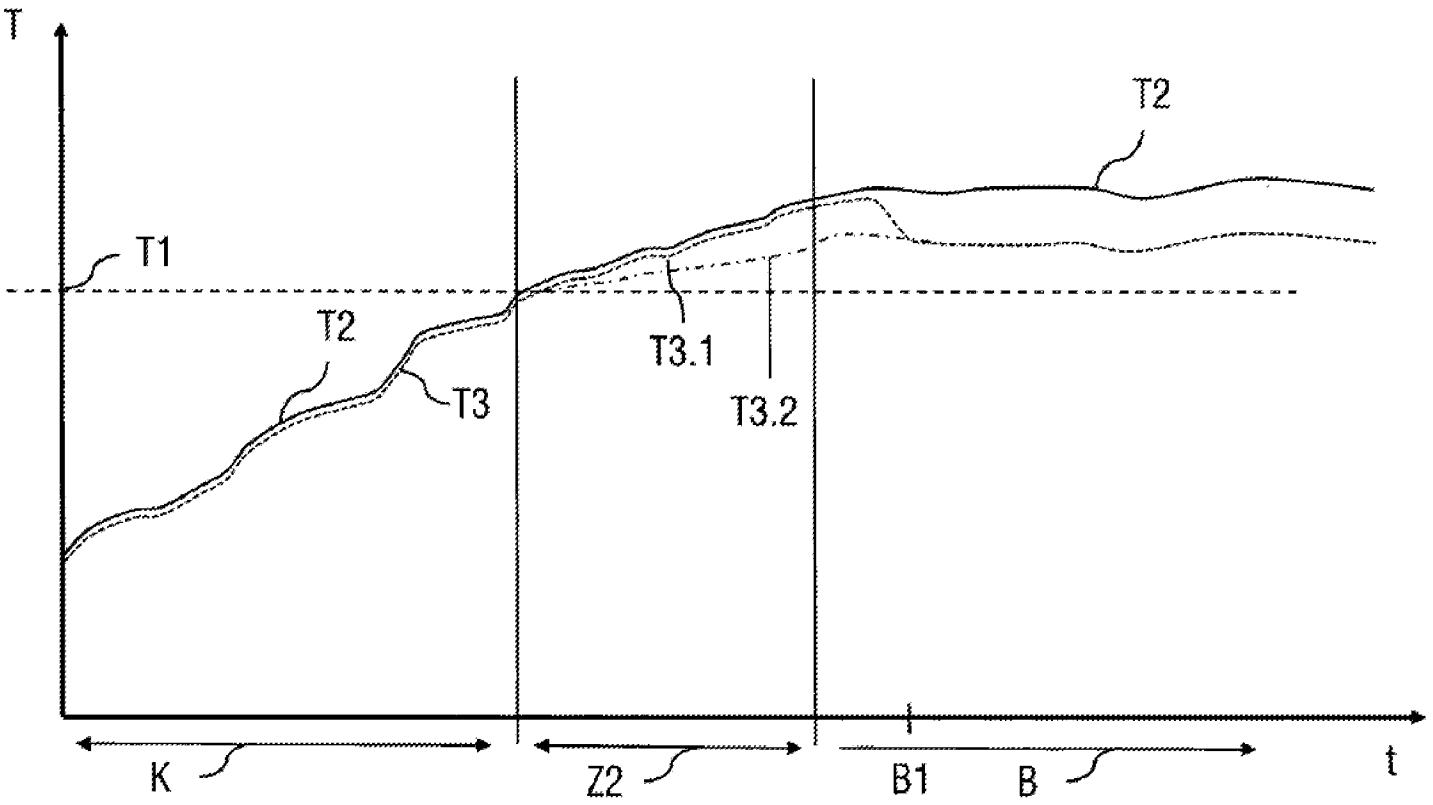
FIG. 4 shows a temperature increase in the event of a functioning oil thermostat and in the event of a defective oil thermostat.

FIG. 4 illustrates a further possibility, according to a variant embodiment, of identifying a malfunction. In FIG. 4, in turn, the dashed line T1 denotes the first temperature threshold value below which the first outlet is closed and above which the first outlet 12 is opened. The progression of the admission temperature T2 over time is measured in turn with the temperature sensor 4 in the oil sump of the oil circuit 1.

FIG. 4 illustrates the progression of the admission temperature T2 over time, starting from a cold start of the motor vehicle. The cold starting range is illustrated by the range indicated by K. During the cold start, the admission temperature greatly increases since the cold engine oil is heated by the driving mode. The temperature range Z2 indicates the thermostat opening range which begins after the admission temperature T2 exceeds the opening temperature T1. The following range B indicates a range of operationally hot inertia.

The dashed line which is indicated by the reference sign T3 indicates the progression of the oil temperature which is measured before the internal combustion engine, but downstream of the oil cooler 16, for example with the temperature sensor 24.

During the cold starting range K below the temperature threshold value T1, the oil cooler is, as expected, closed, and therefore the temperature T3 follows the progression of the admission temperature T2 and lies only minimally below the value thereof, because of the abovementioned radiating effects of the cooler 16.

When the temperature threshold value T1 is reached and exceeded, the final control element of the oil thermostat 10 should progressively open the first outlet 12. In the event of a normally functioning oil thermostat, the progression which is indicated by the chain-dotted line T3.2 would arise. In this case, the temperature difference ΔT=T2−T3.2 increases gradually.

FIG. 4 furthermore shows a temperature progression over time, which is indicated by the dashed line T3.1 and which can be measured at the sensor 24 in the event of a slightly defective oil thermostat 10. The temperature difference between admission temperature T2 and temperature T3.1 after the oil cooler does not diverge too rapidly here, as according to the progression T3.2, although the temperature difference ΔT after the point B1 is in turn identical for both temperature progressions.

However, it has been ascertained within the scope of the invention that, in the case of an oil thermostat 10, the final control element of which is already displaying the onset of a jamming behavior or slight sticking, the temperature progression T3.1 can be observed, and therefore the final control element initially "jams" in the range Z2 and only at a later time "tears loose" and jumps abruptly into the complete open position. Such a jamming behavior is an indication of a future complete jamming of the oil thermostat 10.

According to this variant, the evaluation device 40 identifies such an erroneous behavior in the increase of the temperature difference ΔT, when the increase of the temperature difference proceeds more slowly than a predefined desired increase of the temperature difference. In other words, the progression of the temperature difference over time is detected. If said progression is less pronounced than a predefined desired increase which is stored in the evaluation device 40 in the form of an experimentally determined characteristic curve, a malfunction of the oil thermostat 10 is detected. One possibility for ascertaining a malfunction here is to predefine a minimum value for the temperature difference from T2 and T3 that has to be reached after a predefined reaction period has elapsed after the opening temperature T1 is exceeded. If the measured temperature difference after expiry of the predefined reaction period is smaller than the minimum value for the temperature difference, a malfunction is present.

If the evaluation device 40 therefore identifies one of the temperature progressions illustrated in FIGS. 2 to 4, a defective behavior of the oil thermostat 10 is diagnosed.

It should furthermore be pointed out that industrialized thermostats may already be subject in the new state to a control temperature tolerance. This can basically be taken into consideration in the evaluation unit; for example, in the event of a continuous increase in wear of the thermostat, the defined temperature limit T1 and T1*, which lead to a movement of the control mechanism are increasingly more frequently broken or displaced. In the evaluation unit, calculation sequences can therefore be active and characteristic fields can be stored, which adapt the defined temperature limits T1 and T1* and/or the threshold limits ΔT1 and ΔT2 for the monitoring variants of FIGS. 2 to 4 due to wear in order thus to signal the exchange or defect of the thermostat only if the correct operation of the engine would beyond doubt no longer be ensured.

Figure 5:
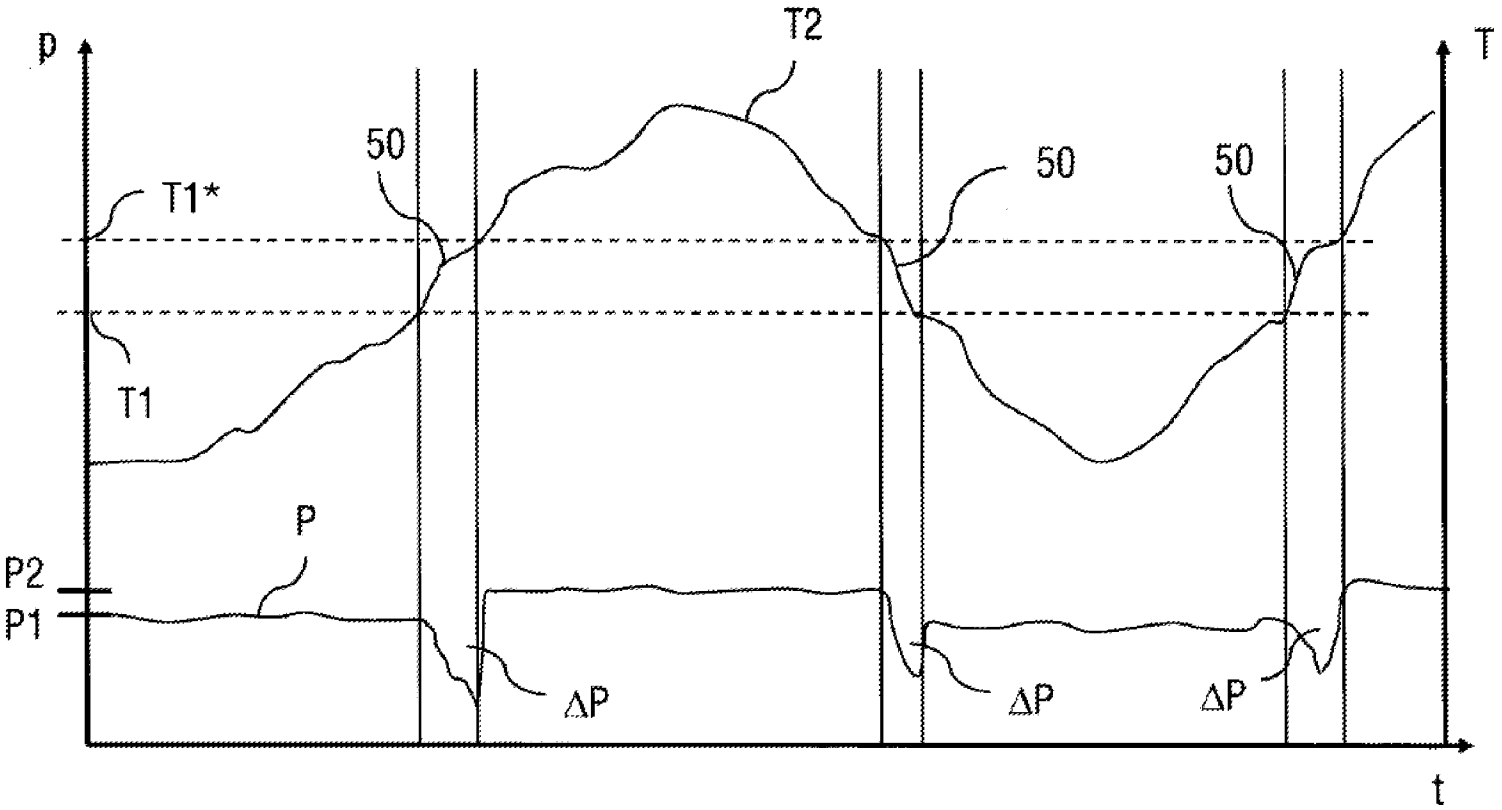
FIG. 5 shows an oil pressure progression depending on the oil temperature.

FIG. 5 illustrates a further possibility according to the invention for identifying whether the oil thermostat 10 is defective. In this case, the sensor device is designed to measure a pressure progression over time by means of a pressure sensor 15 which is arranged in the first flow branch 17 between the first outlet 12 of the oil thermostat 10 and the oil cooler 16. Furthermore, the sensor device in turn determines the progression of the admission temperature T2 over time, for example by means of the temperature sensor 4.

In FIG. 1, the range between the two temperature threshold values T1 and T1* of the oil thermostat is indicated by the dashed lines. As already mentioned above, in the case of a normally functioning oil thermostat, the first outlet 12 is closed when the admission temperature T2 lies below the value T1. Above the temperature T1* the first outlet is completely opened and a second outlet 13 is completely closed. Within the temperature transition range 50 between T1 and T1* the first outlet 12 is opened and the second outlet 13 is only partially closed, and therefore oil flows both through the first flow branch 17 and also through the second flow branch 18.

The pressure progression over time, as measured by the pressure sensor 15, is depicted by the curve P. The pressure progression P describes the progression of a normally functioning oil thermostat 10. Within the temperature ranges of the admission temperature T2 below T1, the pressure progression substantially has the value P1 and, within the ranges in which the admission temperature lies above the value T1*, the value P2. P2 here is essentially somewhat higher than P1 since the oil cooler 16 has a higher flow resistance than the bypass line 18 and therefore leads to increased pressure values P2. However, within the transition range between T1 and T1*, the two lines are at least partially opened, and therefore the flow resistance is lowest within this range. This leads to a negative pressure peak ΔP within the range of the pressure progression over time between T1 and T1*.

If a pressure peak ΔP of this type within the range of the pressure progression over time is measured within the temperature transition range 50 between T1 and T1*, it can be concluded therefrom that the thermostat value 10 operates correctly. However, if the evaluation device 40 identifies on the basis of the measured pressure progression P that no such pressure swing ΔP occurs within the temperature transition range 50, it can be concluded therefrom that the final control element of the oil thermostat 10 has not moved as expected and therefore there is a malfunction.

Instead of the pressure sensor 15 which is arranged between the oil thermostat and oil cooler 16, the pressure progression can also be measured, for example, with the pressure sensor 25 which is arranged after the oil filter. In this case, the desired pressure progression differs from that illustrated in FIG. 5 by the fact that a positive peak is measured within the transition ranges between T1 and T1* since the oil throughflow quantity is at the greatest at the measurement point of the pressure sensor 25 within this range. If, in turn, and analogously to FIG. 5, within the transition range, a positive peak is not measured within said range, it can again be concluded that there is a malfunction.

The temperature sensors 4, 14*a*, 14*b* and 24 and the pressure sensors 15 and 25 have all been illustrated simultaneously in FIG. 1 to simplify the illustration. However, it is emphasized that, depending on the variant embodiment of the sensor apparatus, only some of said sensors have to be present in the oil circuit 1, for example it may be sufficient, depending on the variant embodiment, to use the temperature sensor 4 for determining the admission temperature and additionally also to use the sensor 14*b* or 24 for determining the differential temperature. Instead of the temperature sensors 14*b* and 24, it may also be possible, for example, to provide only one pressure sensor 15 or 25 if a defect is identified on the basis of the pressure progression P and not on the basis of the differential temperature ΔT. In the present case, the oil thermostat 10, the oil cooler 16, the oil filter 20, the filter service valve 21, the filter circumventing valve 22, the oil syphon 23 and also the sensors 14*a*, 15, 23 and 24 are structurally integrated in an oil module which is illustrated with the chain-dotted line 27.

Figure 6:
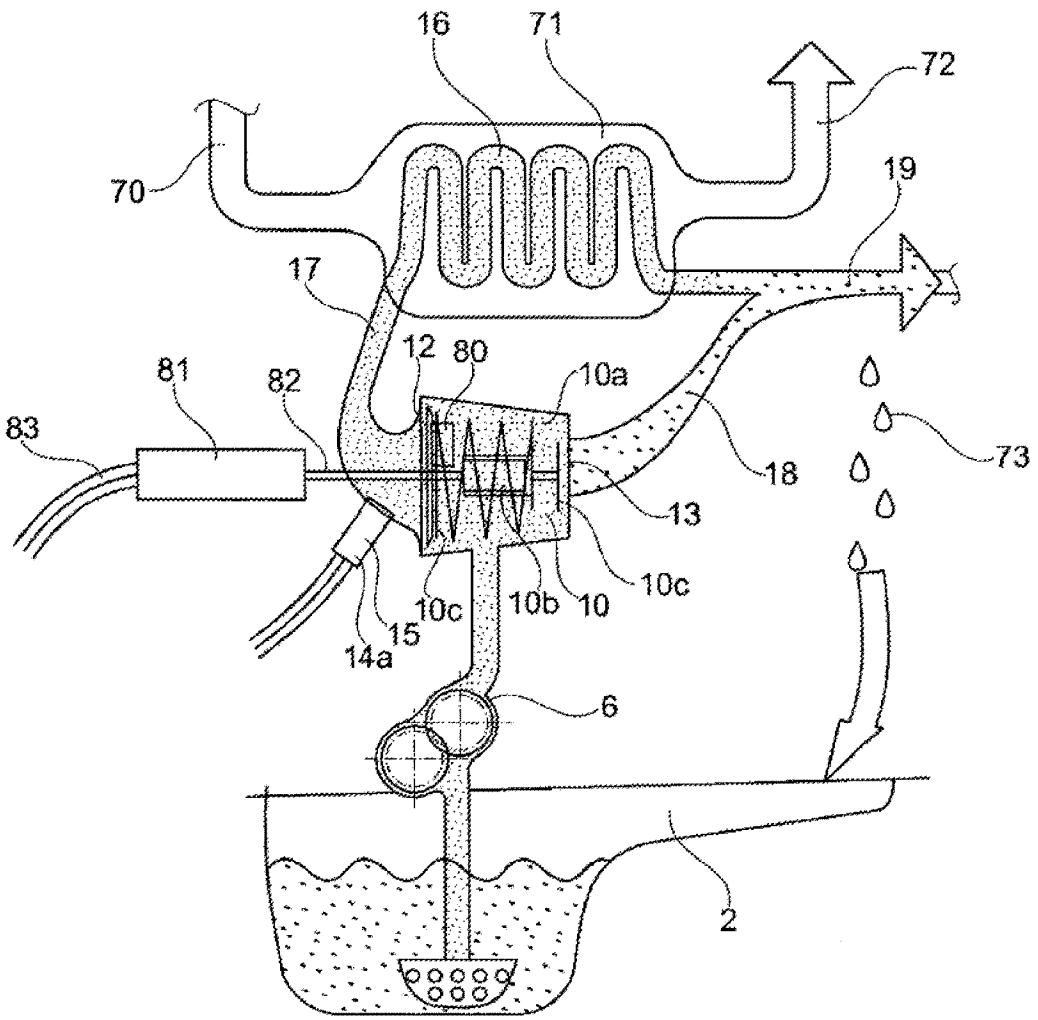
FIG. 6 shows variant embodiments for determining the position and/or movement of the final control element of the oil thermostat.
Figure 7:
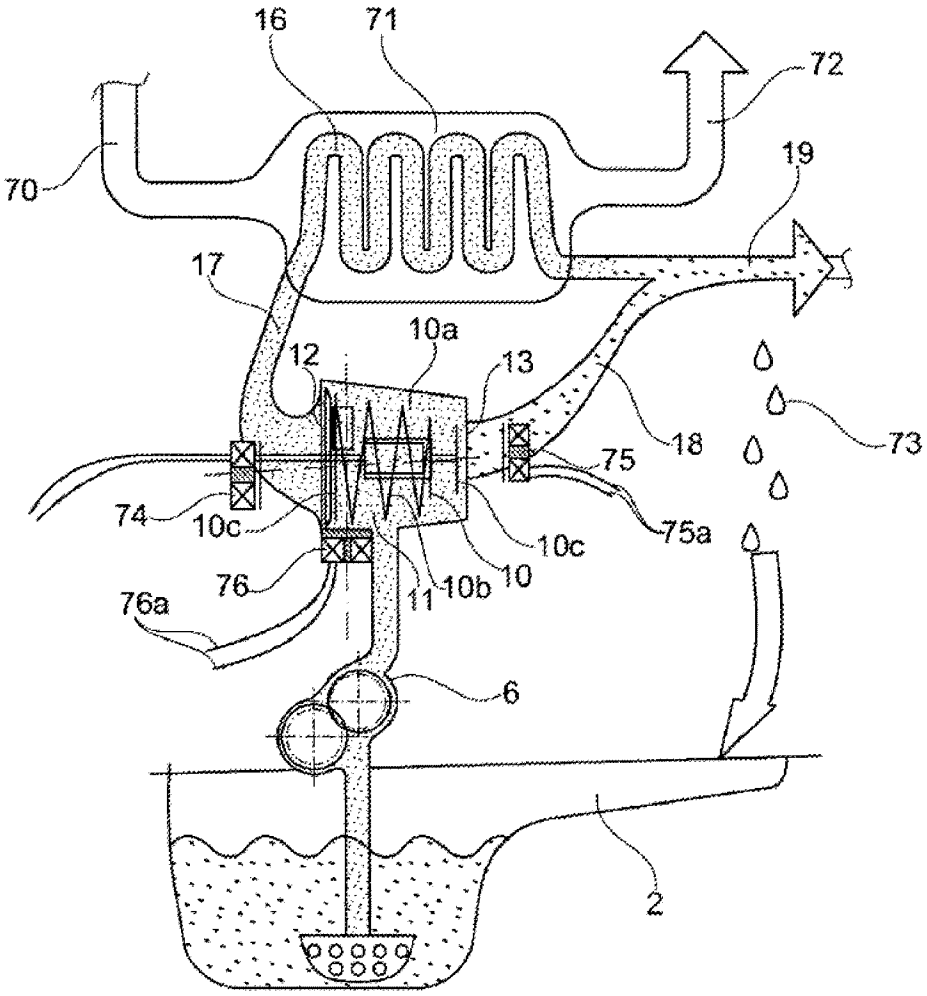
FIG. 7 shows further variant embodiments for determining the position and/or movement of the final control element of the oil thermostat.

Further embodiments of the invention are illustrated below with FIGS. 6 and 7. FIG. 6 first of all in turn illustrates part of an oil circuit, now in a schematized structural illustration. The reference sign 2 refers in turn to the oil pan and the reference sign 6 to the oil pump which conveys oil out of the oil pan 2 and supplies the oil to the oil thermostat 10. The reference sign 12 in turn refers to the first outlet of the oil thermostat 10 which supplies oil to the oil cooler 16 via the first flow branch 17. The reference sign 13 in turn refers to the second outlet of the oil thermostat 10, via which oil can be supplied to the bypass flow branch 18. In addition, FIG. 7 illustrates part of the cooling water circuit with a cooling water supply line 70, a region 71 which forms part of the oil cooler functionality and in which the cooling water flows around the meandering oil line of the oil cooler 16, and a line portion 72 via which the cooling water heated in the oil cooler 16 is removed. The reference sign 73 indicates merely in greatly schematized form the return of the oil back to the oil pan 2 after passing through the region of the internal combustion engine.

The reference signs 14*a* and 15 in turn denote the temperature and pressure sensors which have already been illustrated in FIG. 1 and are arranged in the first flow branch 17 after the first outlet 12 of the oil thermostat 10. Said temperature and pressure sensors are designed here in a structural unit as a combination sensor unit 14*a*, 15 which can be used both for measuring pressure and measuring temperature.

Instead of the combined oil pressure and temperature sensor 14*a*, 15 the function of the oil thermostat can also be monitored directly by means of a displacement sensor 81 in which a coupling rod 82 is directly mechanically coupled in terms of movement to the final control element 10*b* of the oil thermostat 10. According to this variant embodiment, the movement of the final control element 10*b* of the oil thermostat 10 is therefore directly detected by the displacement sensor 81 and output by the displacement sensor 81 to the evaluation device 40 via an output line 83. According to this variant embodiment, the evaluation device 40 is designed to diagnose a malfunction when the final control element 10*b* does not move when the opening temperature T1 is exceeded or in general when the temperature range between T1 and T1* is reached.

FIG. 6 illustrates yet another variant embodiment as an alternative to the use of the displacement sensor 81. Instead, an integrated switching circuit 80 can be provided in the interior of the oil thermostat 10, said switching circuit being designed to detect a position and/or movement of the final control element 10*b* of the oil thermostat 10 by means of integrated switching contacts.

In this connection, a switching contact of the switching circuit 80 is arranged at one end of the final control element 10*b* and detects a movement of a valve disk 10*c* of the final control element 10*b* when the latter moves in order to close or to open an outlet of the oil thermostat 10 and, in the process, comes into contact or out of contact with the switching contact.

Furthermore, the integrated switching circuit 80 is designed to extract its supply energy from the oil heat by means of what is referred to as an energy-harvesting switching circuit. Energy-harvesting switching circuits of this type are known per se from the prior art. Furthermore, the switching circuit 80 is designed to transmit its measurement signals wirelessly to the evaluation device 40 by means of a close range radio transmission. As a result, the integrated switching circuit can be completely encapsulated by the oil thermostat 10, and therefore no additional sealing elements, signal lines or energy supply lines have to be provided.

FIG. 7 illustrates two further variant embodiments of the invention which are in turn illustrated simultaneously in FIG. 7, but can each be used separately.

In contrast to the variants of FIG. 6, the movement of the final control element 10*b* of the oil thermostat 10 is now determined inductively either by means of an oscillating circuit with one coil 76 or by means of two coils 74 and 75.

According to a first variant, the sensor device comprises an electric oscillating circuit with a coil 76, wherein the coil 76 is arranged from the outside on the housing 10*a* of the oil thermostat 10. The coil here is arranged in such a manner that a movement of the final control element 10*b* of the oil thermostat 10, which final control element is designed magnetically, changes the inductance of the coil 76 and therefore an oscillation frequency of the oscillating circuit. The measurement signal of the oscillating circuit with the coil 76 is transmitted to the evaluation device 40 via a signal line 76*a*.

The evaluation device 40 can therefore in turn monitor the function of the oil thermostat 10 by determining on the basis of one of the aforementioned possibilities for determining a first parameter, from which the desired operation of the oil thermostat can be deduced, when a final control element of the oil thermostat 10 would have to move. On the basis of the detected frequency of the oscillating circuit, the evaluation device 40 can furthermore establish whether an anticipated movement of the final control element 10*b* is actually taking place at the anticipated time or whether, for example, the final control element is jamming and therefore no change of the oscillation frequency can be measured.

A further possibility for the contactless identification of the movement of the final control element 10*b* of the oil thermostat 10 is to design the sensor device in such a manner that a transmitter coil 74 and a receiver coil 75 are arranged on respectively opposite sides from the outside on the oil thermostat housing 10*b* or in the vicinity thereof. A movement of the magnetic final control element 10*b* of the oil thermostat 10 then changes a signal which is induced in the receiver coil 75 by the transmitter coil 74 and is transmitted to the evaluation device 40 via a signal line 75*a*. This change can in turn be diagnosed by the evaluation device 40, and therefore the presence of such a change of the signal received with the receiver coil correspondingly indicates a normal function of the oil thermostat. If, at the anticipated time according to the desired operation, no such change of the signal received by the receiver coil is measured, a malfunction of the oil thermostat 10 is present.

The invention is not restricted to the preferred exemplary embodiments described above. On the contrary, a multiplicity of variants and modifications are possible which likewise make use of the inventive concept and therefore fall within the scope of protection. In particular, the invention also claims protection for the subject matter and the features of the dependent claims independently of the claims referred back to.

LIST OF REFERENCE SIGNS

1 Oil circuit
2 Oil pan
2*a* Oil sump
3 Oil level probe
4 Oil sump temperature sensor
5 Admission line
6 Oil pump
7 Pressure control valve
8 Non-return valve
9 Oil control line
10 Oil thermostat valve
10*a* Oil thermostat valve housing
10*b* Final control element
10*c* Valve disk
11 Inlet
12 First outlet
13 Second outlet
14*a* Oil temperature sensor
14*b* Oil temperature sensor
15 Oil pressure sensor
16 Oil cooler
17 First flow branch
18 Bypass flow branch
19 Oil line
20 Oil filter
21 Filter service valve
22 Filter circumventing valve
23 Syphon in the oil filter head
24 Oil temperature sensor
25 Oil supply to the internal combustion engine
26 Oil line
27 Oil module
40 Evaluation device
41 Signal input line
42 Signal output line
50 Temperature transition range
70 Cooling water supply line
71 Cooling water flow-around region
72 Cooling water removal line
73 Oil return
74 Transmitter coil
75 Receiver coil
75*a* Receiver coil signal lines
76 Oscillating circuit
76*a* Oscillating circuit signal lines
80 Integrated switching circuit
81 Displacement sensor
82 Coupling rod
83 Signal lines
B Range of operationally hot inertia
K Cold starting phase
P Pressure progression
ΔP Pressure swing (Peak)
T1 First temperature threshold value
T1* Second temperature threshold value
T2 Admission temperature
T3 Second oil temperature
T3.1 Temperature gradient in the event of defective behaviour
T3.2 Temperature gradient in the event of normal behaviour
ΔT Temperature difference
ΔT1 First threshold value
ΔT2 Second threshold value
Z1 Reaction period
Z2 Thermostat opening range

The invention claimed is:

1. An apparatus for monitoring an oil thermostat arranged in an oil circuit of an internal combustion engine, wherein the oil thermostat is configured to supply an oil flow to a first flow branch in which an oil cooler is arranged or to a bypass flow branch depending on an admission temperature (T2) of the oil flow supplied to the oil thermostat which is measured at an oil sump, wherein a first outlet of the oil thermostat, which outlet is assigned to the first flow branch, is closed when the admission temperature (T2) lies below a first temperature threshold value (T1), wherein the apparatus comprises:

(a) a sensor device which is configured to measure the admission temperature (T2) of the oil as a first parameter by means of which a current desired operation of the oil thermostat can be derived, and to determine at least one second parameter by means of which a current actual operation of the oil thermostat can be derived; and (b) an evaluation device which is configured, depending on the first parameter and the second parameter, to identify an occurrence of a malfunction of the oil thermostat, wherein (a) the sensor device is configured to measure a second oil temperature (T3) downstream of the oil cooler and upstream of the internal combustion engine and to determine a temperature difference (ΔT) from the admission temperature (T2) minus the second oil temperature (T3) as the second parameter; and (b) the evaluation device identifies the occurrence of a malfunction of the oil thermostat, (b1) when the admission temperature (T2) lies below the first temperature threshold value (T1), at least one predetermined reaction period (Z1) has elapsed since the admission temperature (T2) has been below the first temperature threshold value (T1), and the temperature difference (ΔT) is greater than a first threshold value (ΔT1), or (b2) when the admission temperature (T2) is above the first temperature threshold value (T1) at least one predetermined reaction period (Z1) has elapsed since the admission temperature (T2) has been above the first temperature threshold value (T1), and the temperature difference (ΔT) is smaller than a second threshold value (ΔT2); or (c) when, after the first temperature threshold value (T1) is exceeded by the admission temperature (T2), an increase of the temperature difference (ΔT) proceeds more slowly than a predetermined desired increase of the temperature difference (ΔT).

2. The apparatus as claimed in claim 1, further comprising a temperature sensor for measuring the second oil temperature (T3), (a) which is arranged upstream of a junction of the first flow branch and of the bypass flow branch or downstream of an oil filter arranged before the internal combustion engine; or (b) which is designed as a combined pressure and temperature sensor; or (c) which is integrated in an oil filter head.

3. The apparatus as claimed in claim 1, wherein the oil thermostat is a sleeve valve oil thermostat or an expansion element oil thermostat, in particular a wax expansion oil thermostat.

4. The apparatus of claim 1, wherein the apparatus is incorporated into a vehicle.

5. The apparatus of claim 4, wherein the vehicle is a commercial vehicle.

6. An apparatus for monitoring an oil thermostat arranged in an oil circuit of an internal combustion engine, wherein the oil thermostat is configured to supply an oil flow to a first flow branch in which an oil cooler is arranged or to a bypass flow branch depending on an admission temperature (T2) of the oil flow supplied to the oil thermostat which is measured at an oil sump, wherein a first outlet of the oil thermostat, which outlet is assigned to the first flow branch, is closed when the admission temperature (T2) lies below a first temperature threshold value (T1), wherein the apparatus comprises:

(a) a sensor device which is configured to measure the admission temperature (T2) of the oil as a first parameter by means of which a current desired operation of the oil thermostat can be derived, and to determine at least one second parameter by means of which a current actual operation of the oil thermostat can be derived; and (b) an evaluation device which is configured, depending on the first parameter and the second parameter, to identify an occurrence of a malfunction of the oil thermostat, wherein (a) the sensor device is configured to measure, as the second parameter, an oil pressure progression (P) at a pressure measurement point which is arranged downstream of the first outlet of the oil thermostat and upstream with respect to the internal combustion engine; and (b) the evaluation device identifies a malfunction of the oil thermostat when the measured progression of the oil pressure (P) does not indicate any pressure swing (ΔP) within a range of the admission temperature (T2) that lies between the first oil temperature threshold value (T1) and a second temperature threshold value (T1*), wherein the second temperature threshold value (T1*) lies above the first temperature threshold value (T1) and specifies a temperature threshold above which a second outlet of the oil thermostat, which outlet is assigned to the bypass flow branch, is completely closed.

7. The apparatus as claimed in claim 6, wherein (a) the pressure measurement point is arranged in the first flow branch between the first outlet of the oil thermostat and the oil cooler, and the pressure swing (ΔP) is a negative peak; or (b) the pressure measurement point is arranged downstream of the oil cooler and after a junction of the first flow branch and of the bypass flow branch, and the pressure swing is a positive peak.

8. An apparatus for monitoring an oil thermostat arranged in an oil circuit of an internal combustion engine, wherein the oil thermostat is configured to supply an oil flow to a first flow branch in which an oil cooler is arranged or to a bypass flow branch depending on an admission temperature (T2) of the oil flow supplied to the oil thermostat, wherein a first outlet of the oil thermostat, which outlet is assigned to the first flow branch, is closed when the admission temperature (T2) lies below a first temperature threshold value (T1), (wherein the apparatus comprises:

(a) a sensor device which is configured to measure the admission temperature (T2) of the oil as a first parameter by means of which a current desired operation of the oil thermostat can be derived, and to determine at least one second parameter by means of which a current actual operation of the oil thermostat can be derived; and (b) an evaluation device which is configured, depending on the first parameter and the second parameter, to identify an occurrence of a malfunction of the oil thermostat, wherein (a) a gradient of the oil sump is determined as the second parameter; and (b) the evaluation device establishes, depending on the determined value of the first parameter, a predetermined and stored desired characteristic curve of the gradient of the admission temperature (T2) and identifies a malfunction of the oil thermostat when the measured gradient of the admission temperature does not correspond to the desired characteristic curve.

9. An apparatus for monitoring an oil thermostat arranged in an oil circuit of an internal combustion engine, wherein the oil thermostat is configured to supply an oil flow to a first flow branch in which an oil cooler is arranged or to a bypass flow branch depending on an admission temperature (T2) of the oil flow supplied to the oil thermostat, wherein a first outlet of the oil thermostat, which outlet is assigned to the first flow branch, is closed when the admission temperature (T2) lies below a first temperature threshold value (T1), wherein the apparatus comprises:

(a) a sensor device which is configured to measure the admission temperature (T2) of the oil as a first parameter by means of which a current desired operation of the oil thermostat can be derived, and to determine at least one second parameter by means of which a current actual operation of the oil thermostat can be derived; and (b) an evaluation device which is configured, depending on the first parameter and the second parameter, to identify an occurrence of a malfunction of the oil thermostat, wherein (a) as the second parameter, an oil temperature is measured at a measurement point which is arranged in the first flow branch upstream with respect to the oil cooler; and (b) the evaluation device identifies a malfunction of the oil thermostat when the measured oil temperature in accordance with the second parameter remains substantially unchanged since, in accordance with the determined first parameter, the first outlet would have had to be opened or closed.

10. An apparatus for monitoring an oil thermostat arranged in an oil circuit of an internal combustion engine, wherein the oil thermostat is configured to supply an oil flow to a first flow branch in which an oil cooler is arranged or to a bypass flow branch depending on an admission temperature (T2) of the oil flow supplied to the oil thermostat, wherein a first outlet of the oil thermostat, which outlet is assigned to the first flow branch, is closed when the admission temperature (T2) lies below a first temperature threshold value (T1), wherein the apparatus comprises:

(a) a sensor device which is configured to measure the admission temperature (T2) of the oil as a first parameter by means of which a current desired operation of the oil thermostat can be derived, and to determine at least one second parameter by means of which a current actual operation of the oil thermostat can be derived; and (b) an evaluation device which is configured, depending on the first parameter and the second parameter, to identify an occurrence of a malfunction of the oil thermostat, wherein (a) the sensor device is configured to detect a position or a movement of a final control element of the oil thermostat as the second parameter; and (b) the evaluation device is configured to identify the malfunction of the oil thermostat with reference to the detected position or movement of the final control element.

11. The apparatus as claimed in claim 10, wherein the malfunction of the oil thermostat is identified (a) when no movement of the final control element is detected within a predetermined oil temperature range or cooling water temperature range; or (b) when, during a cold start, the final control element is in a position in which the first outlet is opened; or (c) when, during a driving mode at full load, the final control element is in a position in which the first outlet is closed.

12. The apparatus as claimed in claim 10, wherein the sensor device comprises a displacement sensor which is mechanically coupled in terms of movement to the final control element.

13. The apparatus as claimed in claim 10, wherein (a) the sensor device is designed as an electric oscillating circuit with a coil, wherein the coil is arranged from the outside on or in the vicinity of the oil thermostat in such a manner that a movement of the final control element of the oil thermostat changes the inductance of the coil and therefore an oscillation frequency of the oscillating circuit; or (b) the sensor device has a transmitter coil and a receiver coil which are each arranged on opposite sides from the outside on or in the vicinity of the oil thermostat, and therefore a movement of the final control element of the oil thermostat changes a signal induced in the receiver coil by the transmitter coil.

14. The apparatus as claimed in claim 13, wherein the apparatus is designed as a mobile test apparatus for workshop use, comprising fastening means in order to arrange the sensor device from the outside on the oil thermostat temporarily for a measurement operation.

15. The apparatus as claimed in claim 10, wherein the sensor device is designed as a switching circuit which is integrated in the oil thermostat and is designed (a) to detect a position or movement of the final control element of the oil thermostat by means of integrated switching contacts;

(b) to extract its supply energy from the oil heat by means of an energy-harvesting switching circuit; and (c) to transmit a measurement signal wirelessly, preferably by means of a close range radio transmission, to the evaluation device.

* * * * *